US006123244A

United States Patent [19]

Huang

[11] Patent Number: 6,123,244

[45] Date of Patent: Sep. 26, 2000

[54] STAPLER HAVING A BELT GUIDING MECHANISM

[76] Inventor: Shih Chang Huang, No. 134, Yiau San Street, San Min Chu, Kaoshiung 807, Taiwan

[21] Appl. No.: 09/272,523

[22] Filed: Mar. 22, 1999

[51] Int. Cl.[7] ..... B25C 5/02

[52] U.S. Cl. ..... 227/119; 81/57.37; 81/434; 227/120; 227/136

[58] Field of Search ..... 227/119, 57.37, 227/136, 135, 120, 123; 81/434

[56] References Cited

U.S. PATENT DOCUMENTS

| | | | |
|---|---|---|---|
| 3,891,014 | 6/1975 | Gunn | 81/57.37 |
| 4,404,877 | 9/1983 | Mizuno et al. | 227/136 |
| 4,926,719 | 5/1990 | Kross et al. | 81/57.37 |
| 5,027,679 | 7/1991 | Kawashima et al. | 81/434 |
| 5,101,697 | 4/1992 | Fishback | 81/434 |
| 5,284,074 | 2/1994 | Chen | 81/434 |
| 5,568,753 | 10/1996 | Habermehl et al. | 227/136 |
| 5,826,468 | 10/1998 | Daubinger et al. | 81/434 |

*Primary Examiner*—Peter Vo
*Assistant Examiner*—Jim Calve
*Attorney, Agent, or Firm*—Charles E. Baxley, Esq.

[57] ABSTRACT

A stapler includes a driving tool rotatably received in one end and a sleeve slidably engaged on the driving tool and biased outward of the stapler. A base and a barrel and a latch are secured onto the sleeve. A casing is slidably engaged onto the base. The base includes an arm having a groove for slidably receiving the ends of the fasteners that are secured in a belt. The casing includes a flange for guiding the belt. The latch includes a passage and a slot for guiding the belt and for allowing the belt to stably and smoothly supply the fasteners into the barrel.

6 Claims, 7 Drawing Sheets

STAPLER HAVING A BELT GUIDING MECHANISM

BACKGROUND OF THE INVENTION

1. Field of the Invention

The present invention relates to a stapler, and more particularly to a stapler having a guiding mechanism for guiding the belt that holds the fasteners or the nails to be driven into the work pieces.

2. Description of the Prior Art

Typical staplers comprise a driving member for driving the fasteners or the nails supported in line in a belt. The belt is moved into the stapler step by step for supplying the fasteners into the stapler. However, the stapler has no guiding mechanism for guiding the belt through the stapler such that the belt may not be stably retained in place and may move here and there.

The present invention has arisen to mitigate and/or obviate the afore-described disadvantages of the conventional staplers.

SUMMARY OF THE INVENTION

The primary objective of the present invention is to provide a stapler having a guiding mechanism for stably guiding the belt to move into and to move through stapler and to stably supply the fasteners into the stapler.

In accordance with one aspect of the invention, there is provided a stapler comprising a body including a first end having a chamber formed therein and including a driving tool rotatably received in the chamber of the body, a belt including a plurality of fasteners releasably secured thereon, the fasteners each including a first end and a second end to be engaged into a work piece, a sleeve slidably engaged on the driving tool and including a puncture formed therein for allowing the driving tool to extend outward of the sleeve, means for biasing the sleeve outward of the body to engage onto the driving tool, a base including a head secured onto the sleeve and including a bore formed in the head and aligned with the driving tool for allowing the driving tool to be extended through the bore of the head, the base including an arm having a groove formed therein for slidably receiving the first ends of the fasteners, a barrel engaged on and secured to the head of the base for engaging with the work piece to be driven with the fasteners, a casing including a space formed therein for slidably receiving the arm of the base, the casing including a flange extended inward of the space of the casing for engaging with and for guiding the belt, means for moving the fasteners into the head step by step, and a latch engaged with the head and the barrel for securing the head and the barrel together, the latch including a passage formed therein for slidably receiving the belt and including a slot formed therein for engaging with and for guiding the belt.

The head of the base includes a channel formed therein and communicating with the bore of the base, the barrel includes at least one pair of notches aligned with the channel of the head, the latch includes a beam engaged into the channel of the head and the at least one pair of notches of the barrel for securing the barrel to the head. The latch includes a spring-biased projection means for engaging with the head to secure the latch to the head of the base.

The base includes a spring-biased catch engaged with the casing for biasing the casing toward the head. A pusher is pivotally secured to the casing and has an extension for engaging with and for moving the fasteners into the head, the spring-biased catch is provided for forcing the extension of the pusher to engage with the fasteners. The casing includes a duct formed therein, the pusher includes a shaft rotatably secured in the duct for pivotally securing the pusher to the casing.

The body includes at least on guideway formed therein, the casing includes at least one projection slidably received in the at least one guideway of the body for moving the casing away from the head when the casing and the base are forced toward the body.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 9:
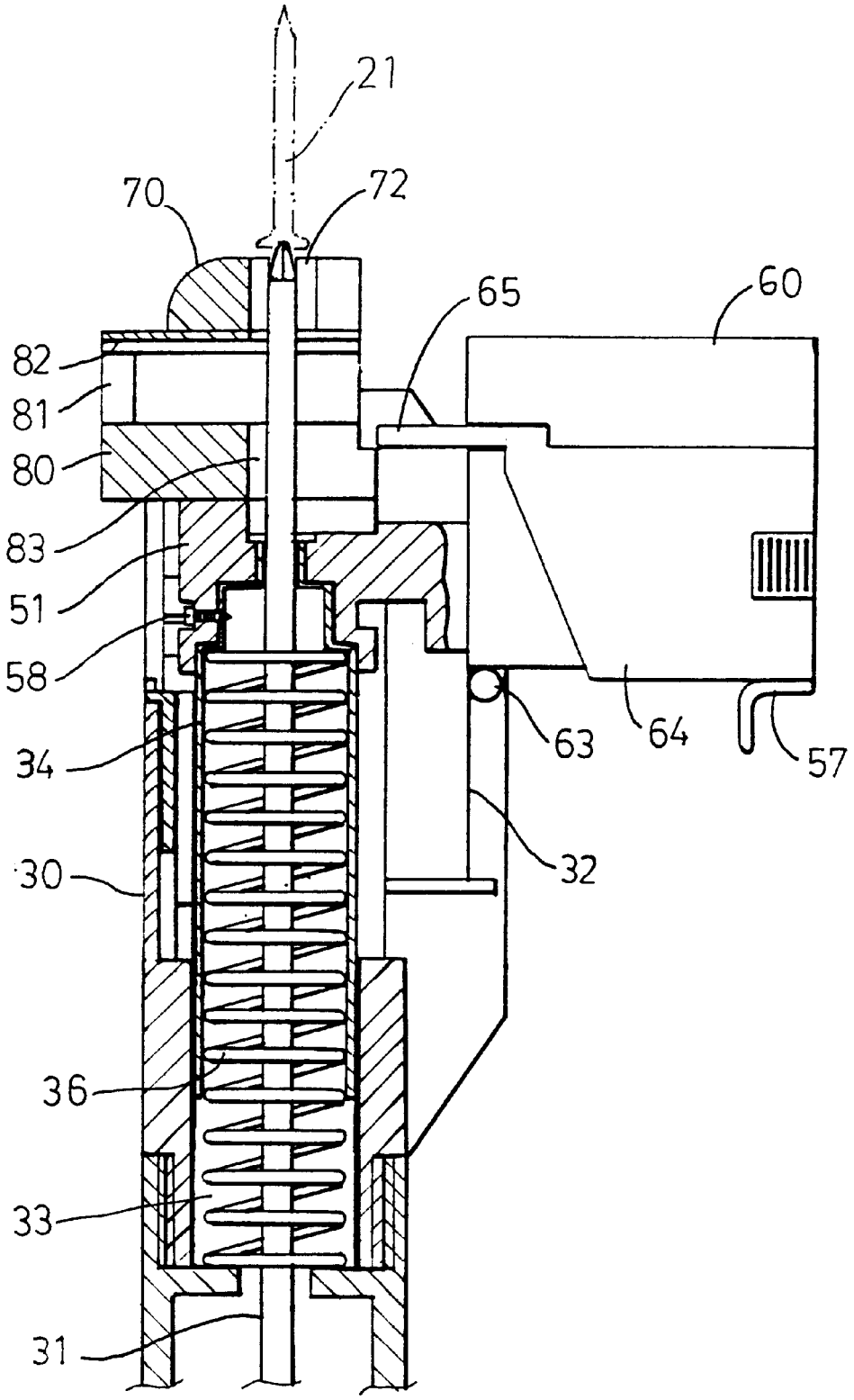
FIG. 9 is a partial cross sectional view similar to FIGS. 4, 6 and 7, illustrating the operation of the stapler.

Referring to the drawings, and initially to FIGS. 1–4, a stapler in accordance with the present invention comprises a body 30 including a driving tool 31 rotatably received in the upper end or the driving end of the body 30 and including a chamber 33 formed in the upper end for slidably receiving a sleeve 34. A spring 36 is engaged between the body 30 and the sleeve 34 (FIG. 9) for biasing the sleeve 34 outward, or for allowing the driving tool 31 to be received in the sleeve 34 (FIGS. 2, 3, 6, 7). the sleeve 34 includes a puncture 38 formed in the upper end thereof for allowing the driving tool 31 to be moved outward to the sleeve 34 when the sleeve 34 is forced inward of the body 30 against the spring 36 (FIG. 9). The body 30 includes a curved or bent guideway 32 formed in the upper end thereof (FIGS. 4, 6, 7, 9).

Figure 1:
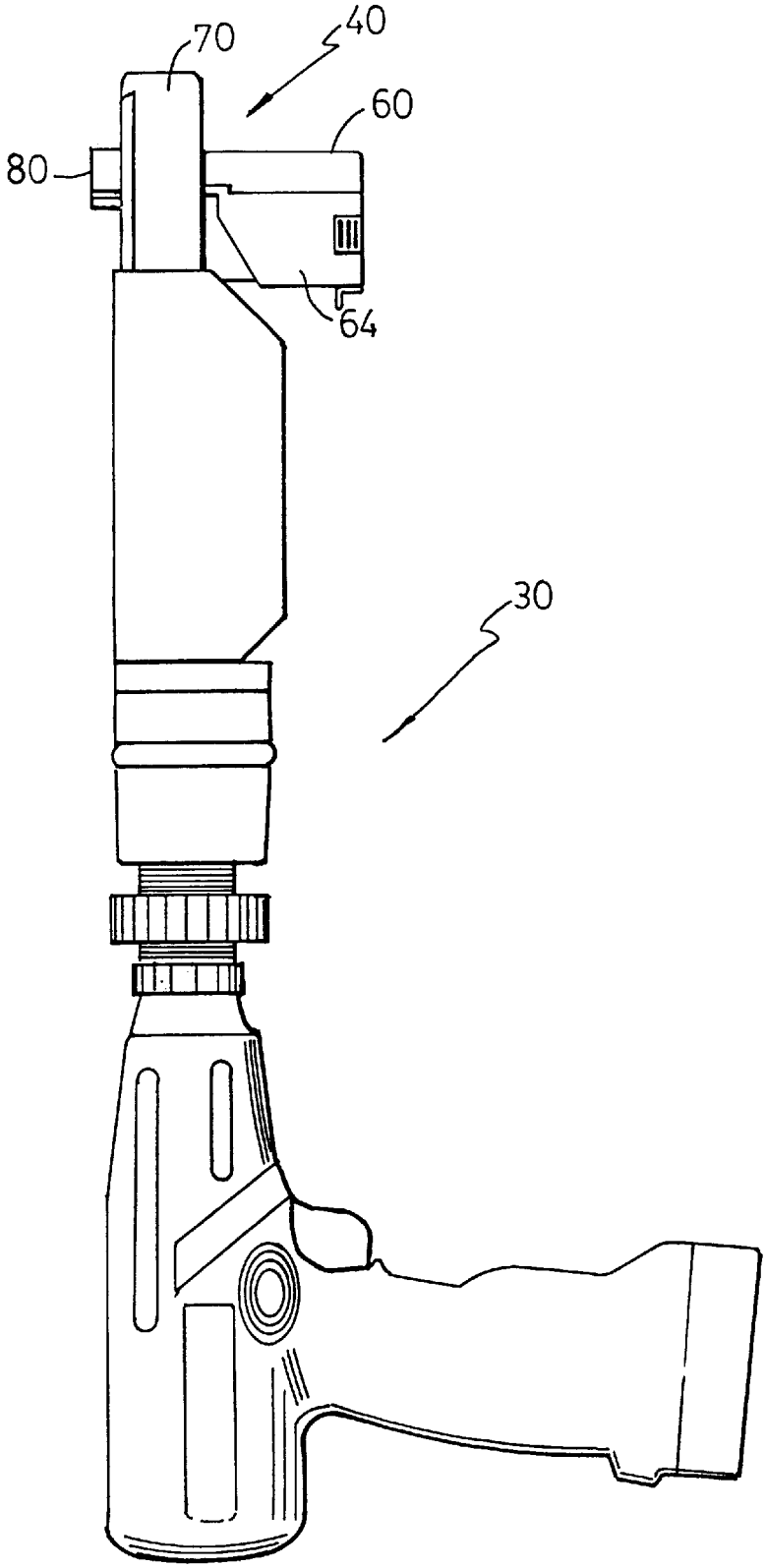
FIG. 1. is a plan view of a stapler in accordance with the present invention.
Figure 2:
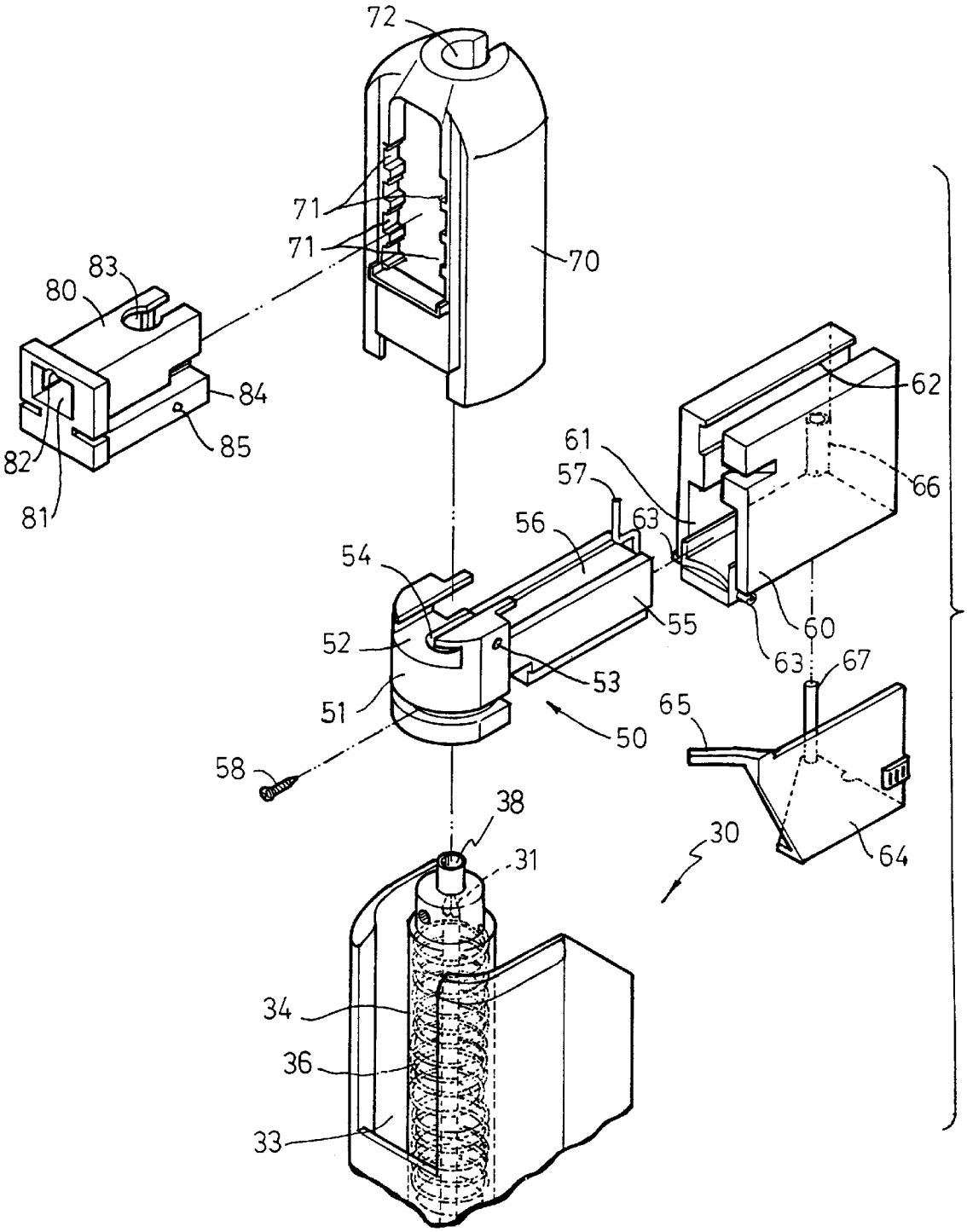
FIG. 2 is a partial exploded view of the stapler.
Figure 4:
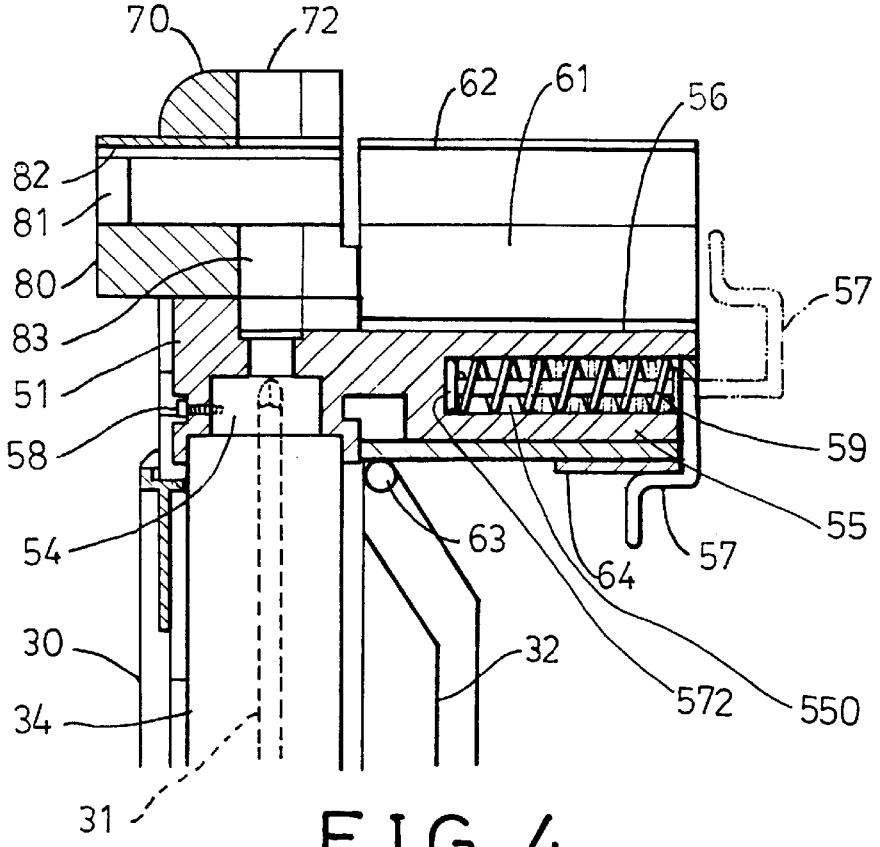
FIG. 4 is a partial cross sectional view taken along lines 4—4 of FIG. 8.
Figure 3:
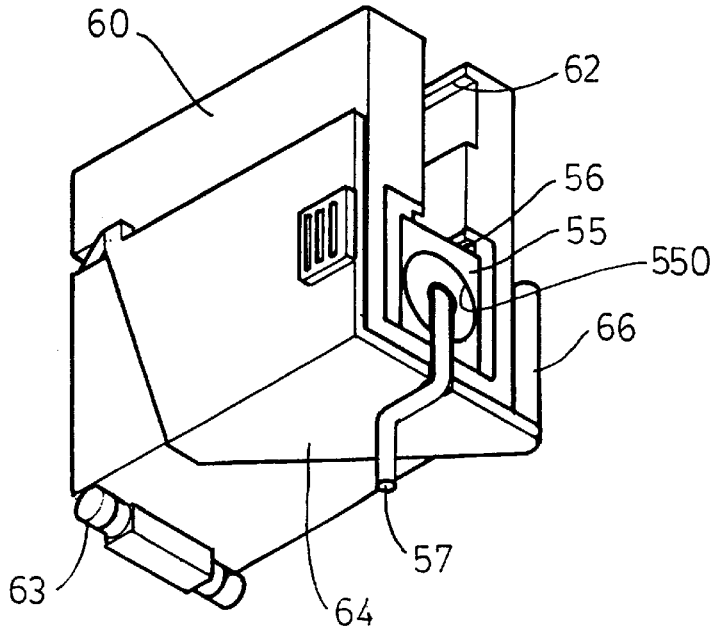
FIG. 3 is a partial perspective view of a belt guiding mechanism of the stapler.
Figure 8:
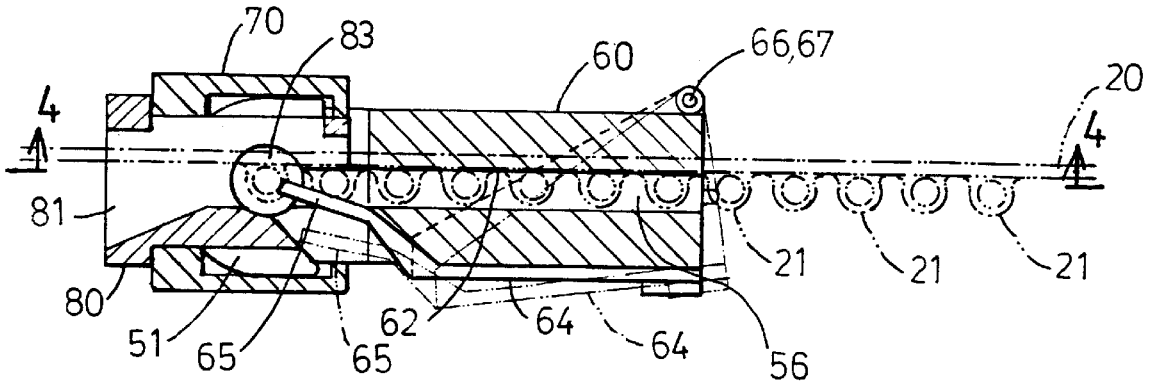
FIG. 8 is a cross sectional view taken along lines 8—8 of FIG. 6.
Figure 6:
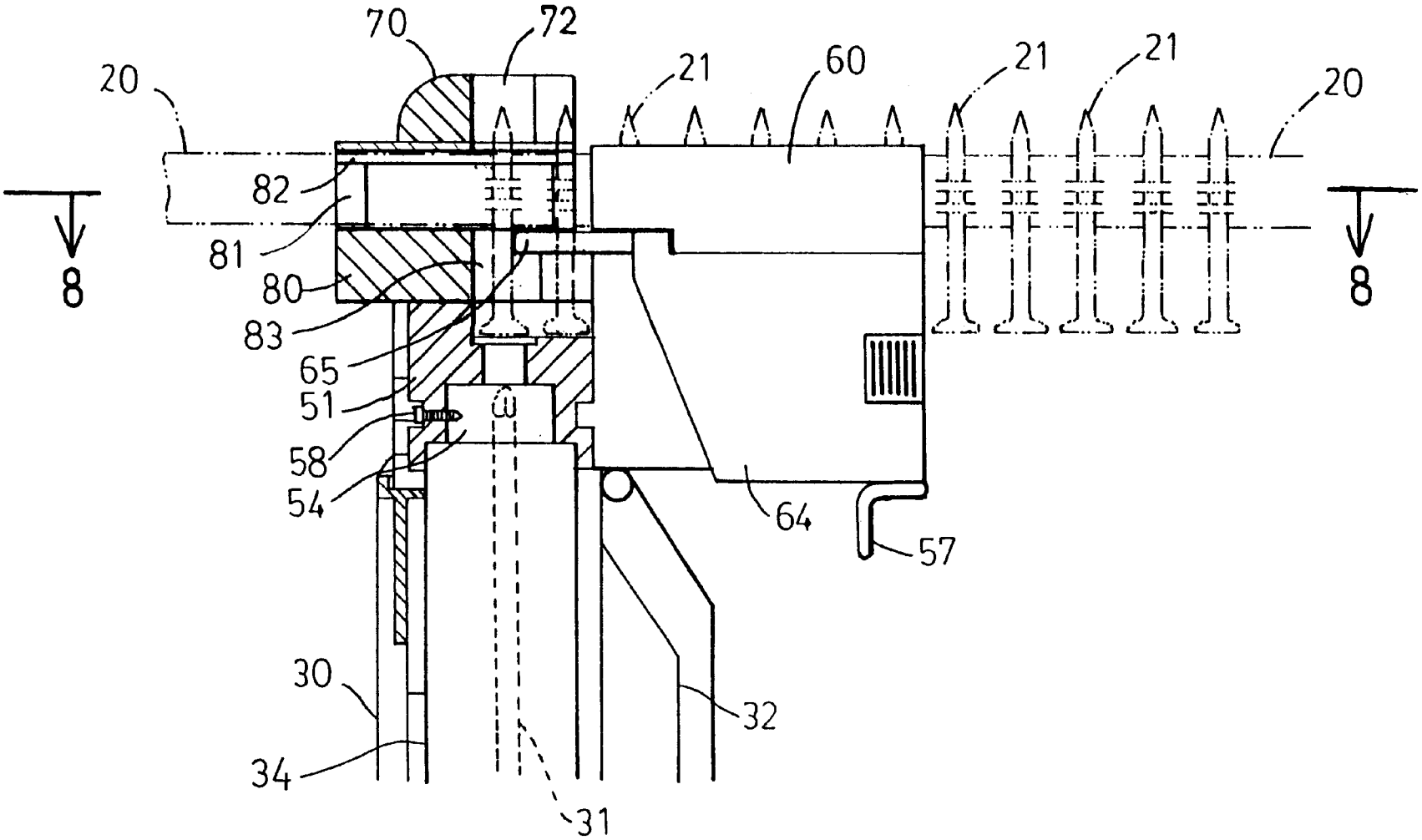
FIGS. 6 and 7 are partial cross sectional view similar to FIG. 4, illustrating the operation of the stapler.
Figure 7:
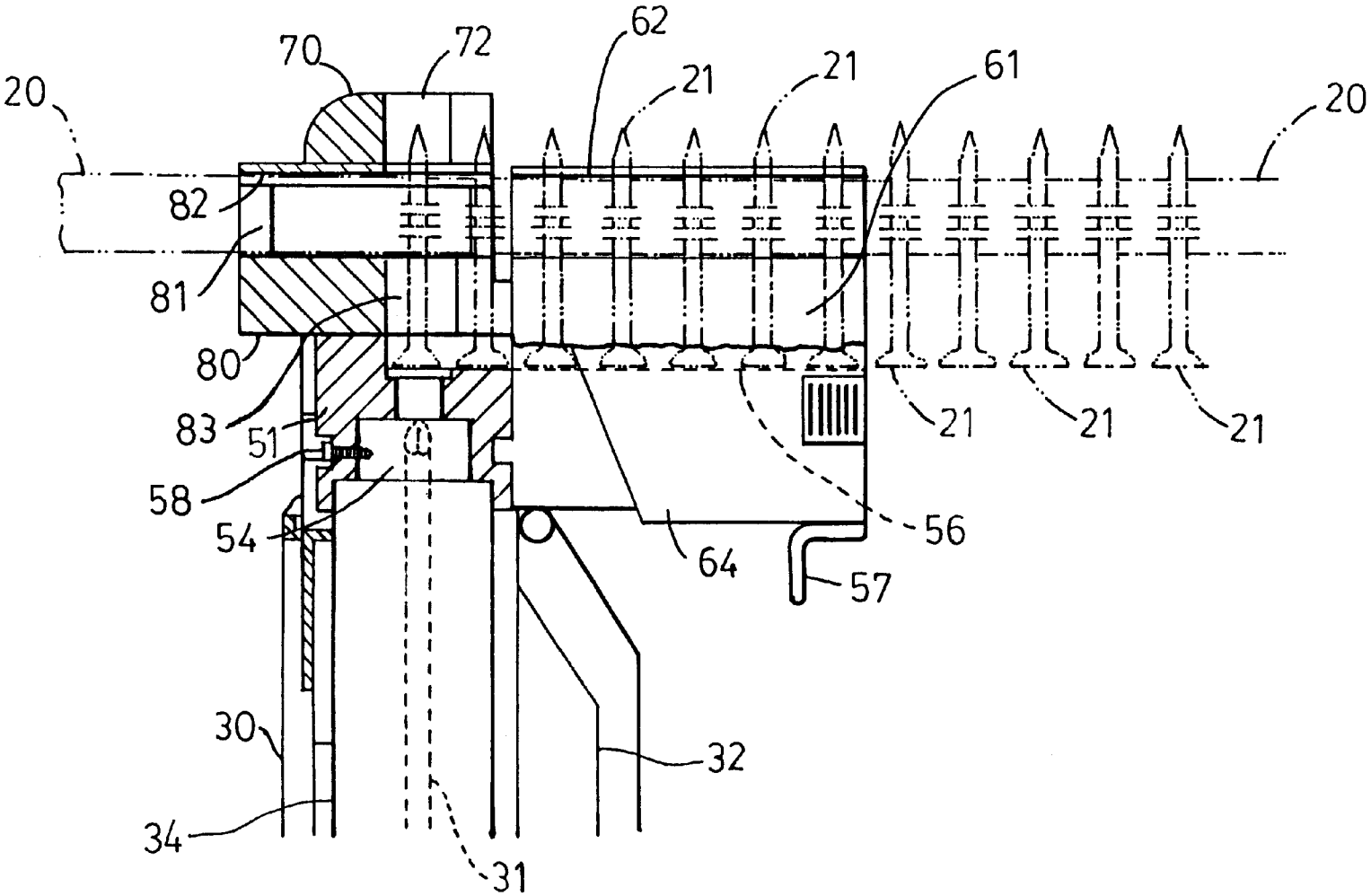

A base 50 includes a head 51 engaged onto the sleeve 34 and secured to the sleeve 34 by one or more fasteners 58. The head 51 includes a channel 52 formed in the upper portion and includes a bore 54 formed therein and communicating with the channel 52 thereof. The head 51 includes one or more cavities 53 formed therein. The base 50 includes an arm 55 extended from the head 51 and having a groove 56 formed in the upper portion thereof and communicating with the bore 54 of the head 51 for receiving and for guiding the belt 20 and the heads of the fasteners 21 into the bore 54 of the base 50 (FIGS. 6–8). The fasteners 21 are releasably secured on the belt 20. As best shown in FIG. 8, the groove 56 has a size substantially equals to that of the belt 20 and the fasteners 21 for stably guiding the belt 20 and the fasteners 21 into the stapler body 30. As shown in FIGS. 3, 4, the arm 55 has a puncture 550 formed therein for receiving a spring 59. A catch 57 has one and end engaged in the puncture 550 of the arm 55 and has a head 572 engaged with the spring 59 such that the spring 59 may bias the catch 57 to engage with the arm 55. The catch 57 has the other end extended outward of the arm 55 and may be rotated relative to the base 50.

A barrel 70 is engaged on the head 51 of the base 50 and has one or more pairs of notches 71 for aligning with the channel 52 of the base 50 (FIG. 5), and includes an outlet 72 aligned with the bore 54 of the head 51 and the driving tool 31 which may extend outward through the outlet 72 (FIG. 9) when the barrel 70 and the base 50 are forced inward of the body 30. A casing 60 includes a space 61 formed therein for slidably engaged onto the arm 55 of the base 50 and includes one or more projections 63 extended therefrom for slidably engaging with the guideway 32 of the body 30 (FIGS. 4, 6, 7, 9). the casing 60 includes a flange 62 extended inward of the space 61 (FIG. 2) for engaging with and for stably guiding the belt 20 to move into the stapler (FIGS. 7, 8). a pusher 64 has a shaft 67 rotatably received in a duct 66 of the casing 60 for pivotally securing the pusher 64 to the casing 60 and for allowing the pusher 64 to be rotated about the shaft 67. The pusher 64 includes an extension 65 extended therefrom for engaging with and for moving the fasteners 21 and the belt 20 forward (FIGS. 6, 8). The catch 57 may act as a spring biasing member for moving the casing 60 and the pusher 64 toward the head 51 of the base 50 (FIGS. 3, 4, 8).

A latch 80 has a beam 84 for engaging into the notches 71 of the barrel 70 and the channel 52 of the base 50 (FIG. 5) and has one or more spring-biased projections 85 engaged into the cavities 53 of the head 51 for securing the barrel 70 and the head 51 of the base 50 together. The latch 80 includes an orifice 83 aligned with the outlet 72 of the barrel 70 for allowing the driving tool 31 to extend outward of the barrel 70. The latch 80 includes a passage 81 formed therein for receiving the guiding the belt 20 and includes a slot 82 formed therein for receiving and guiding the edge portion of the belt 20 and for allowing the belt 20 to be moved smoothly through the passage 81 of the latch 80. It is to be noted that the casing 60 and the pusher 64 are slidably engaged on the arm 55 of the base 50 and retained in place by the spring-biased catch 57. The barrel 70 and the latch 80 are secured to the head 51 of the base 50 which is secured to the sleeve 34 by the fasteners 58 such that the base 50 and the casing 60 and the barrel 70 and the latch 80 and the sleeve 34 may be forced toward the body 30 against he spring 36 when the barrel 70 is forced against the work piece and when the barrel 70 is forced against the work piece and when the fastener 21 is driven into the work piece (FIG. 9).

In operation, as shown in FIGS. 6 and 7, the fasteners 21 are received in the barrel 70 before the fasteners 21 are driven into the work piece. When the barrel 70 is engaged with and forced against a work piece and when the driving tool 31 is actuated to drive the fastener 21 into the work piece, the base 50 and the casing 60 and the barrel 70 and the latch 80 may be forced toward the body 30 against the spring 36 until the tip of the driving tool 31 slightly extends outward of the barrel 70 (FIG. 9), such that the fastener 21 may be fully driven into the work piece. When the casing 60 and the base 50 are forced toward the body 30, the projections 63 of the casing 60 will be forced to move along the guideways 32 of the body 30 and to guide and to move the casing 60 and the 64 away from the head 51 of the base 50 against the spring-biased catch 57. The pusher 64 may also be forced to rotate about the shaft 67 against the catch 57, best shown in dotted lines in FIG. 8, such that the extension 65 of the pusher 64 may be moved to engaged with the next fastener 21. When the fastener 21 has been driven into the work piece and when the barrel 70 is released, the spring-biased catch 57 may force the casing 60 and the pusher 64 toward the head 51 of the base 50 again so as to move the next fastener 21 into the bore 54 of the head 51.

Figure 5:
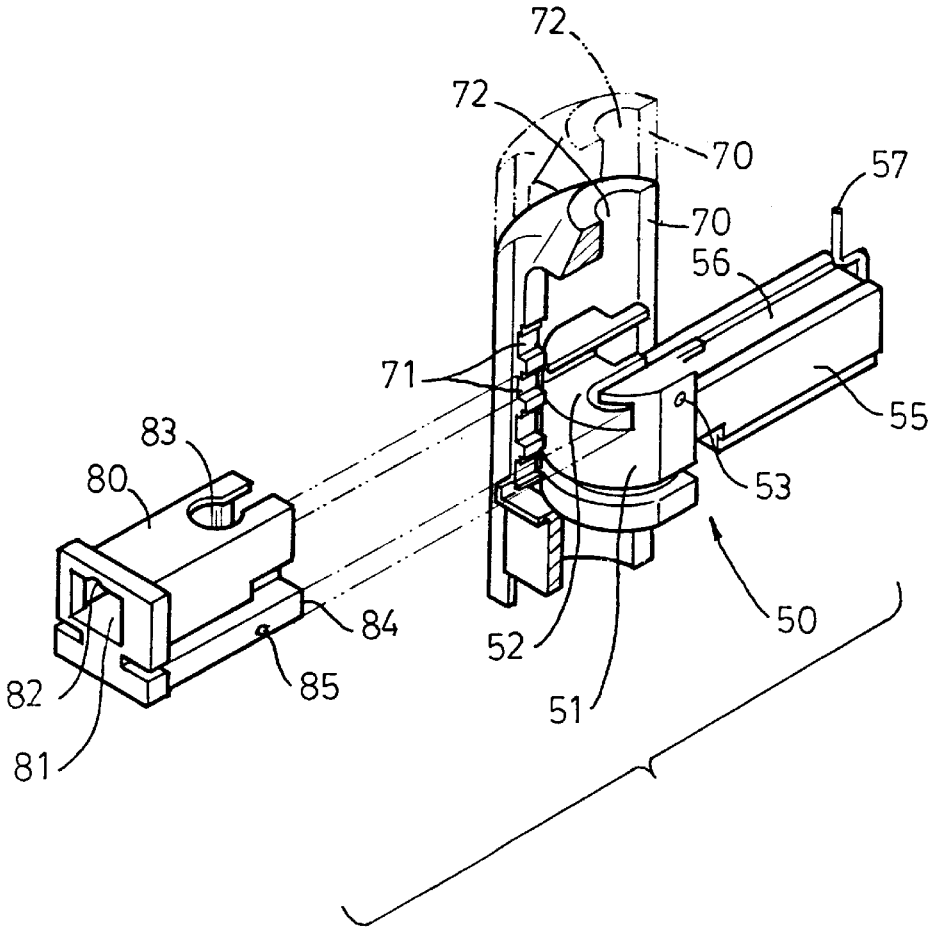
FIG. 5 is a partial exploded view of the belt guiding mechanism of the stapler.

It is to be noted that the sliding engagement of the heads of the fasteners 21 along the groove 56 of the base 50 and the engagement of the flange 62 of the casing 60 with the belt 20 and the sliding engagement of the belt 20 with the slot 82 of the latch 80 may stably guide the belt 20 and the fasteners 21 through the guiding mechanism of the stapler. The pusher 64 may also be used to effectively move the fasteners 21 into the head 51 of the base 50 one by one or step by step. As shown in FIG. 5, the beam 84 of the latch 80 may engage with either pair of the notches 71 for adjusting the distance between the outlet 72 of the barrel 70 and the head 51 according to the sizes of the fasteners 21.

Accordingly, the stapler in accordance with the present invention includes a guiding mechanism for stably guiding the belt to move into and to move through stapler and to stably supply the fasteners into the stapler.

Although this invention has been described with a certain degree of particularity, it is to be understood that the present disclosure has been made by way of example only ad that numerous changes in the detailed construction and the combination and arrangement of parts may be resorted to without departing from the spirit and scope of the invention as hereinafter claimed.

I claim:

1. A stapler comprising:

a body including a first end having a chamber formed therein and including a driving tool rotatably received in said chamber of said body, a belt including a plurality of fasteners releasably secured thereon, said fasteners each including a first end and a second end to be engaged into a work piece, a sleeve slidably engaged on said driving tool and including a puncture formed therein for allowing said driving tool to extend outward of said sleeve, means for biasing said sleeve outward of said body to engage onto said driving tool, a base including a head secured onto said sleeve and including a bore formed in said head and aligned with said driving tool for allowing said driving tool to be extended through said bore of said head, said base including an arm having a groove formed therein for slidably receiving said first ends of said fasteners, said head of said base including a channel formed therein and communicating with said bore.

a barrel engaged on and secured to said head of said base for engaging with the work piece to be driven with said fasteners, said barrel including at least one pair of notches aligned with said channel of said head, a casing including a space formed therein for slidably receiving said arm of said base, said casing including a flange extended inward of said space of said casing for engaging with and for guiding said belt, means for moving said fasteners into said head step by step, and a latch engaged with said head and said barrel for securing said head and said barrel together, said latch including a passage formed therein for slidably receiving said belt and including a slot formed therein for engaging with and for guiding said belt, said latch including a beam engaged into said channel of said head and said at least one pair of notches of said barrel for securing said barrel to said head, and said latch including a spring-biased projection means for engaging with said head to secure said latch to said head of said base.

2. The stapler according to claim 1, wherein said fasteners moving means includes a pusher pivotally secured to said casing and having an extension for engaging with an for moving said fasteners into said head.

3. The stapler according to claim 1, wherein said base includes a spring-biased catch engaged with said casing for biasing said casing toward said head.

4. The stapler according to claim 3 further comprising a pusher pivotally secured to said casing and having an extension for engaging with and for moving said fasteners into said head, said spring-biased catch being provided for forcing said extension of said pusher to engage with said fasteners.

5. The stapler according to claim 4, wherein said casing includes a duct formed therein, said pusher includes a shaft rotatably secured in said duct for pivotally securing said pusher to said casing.

6. The stapler according to claim 1, wherein said body includes at least one guideway formed therein, said casing includes at least one projection slidably received in said at least one guideway of said body for moving said casing away from said head when said casing and said base are forced toward said body.

* * * * *